US005501453A

United States Patent [19]

Hurst

[11] Patent Number: 5,501,453

[45] Date of Patent: Mar. 26, 1996

[54] PRETENSIONED GOLF CLUB HEAD

[75] Inventor: Douglas Hurst, Montreal, Canada

[73] Assignee: Stokes & Co., Inc., Kingwood, Tex.

[21] Appl. No.: 379,750

[22] Filed: Jan. 27, 1995

[51] Int. Cl.[6] ..... A63B 53/04

[52] U.S. Cl. ..... 273/78; 273/173; 273/169; 273/167 H

[58] Field of Search ..... 273/167 R, 167 H, 273/167 E, 187.4, 78, 186.1, 186.2, 193 R, 194 R, 194 B, 79, 169, 167 F, 173, 162 R, 167 D, DIG. 22; D21/214, 215

[56] References Cited

U.S. PATENT DOCUMENTS

| | | | |
|---|---|---|---|
| 1,594,850 | 8/1926 | Perkins | 273/79 |
| 1,644,177 | 10/1927 | Collins | 273/79 |
| 2,201,638 | 5/1940 | Theibault | 273/167 H |
| 3,571,900 | 3/1971 | Hardesty | 273/173 |
| 3,888,492 | 6/1975 | Cabot | 273/78 |
| 4,002,343 | 1/1977 | Eckert | 273/187.4 |
| 4,067,572 | 1/1978 | Coleman | 273/173 |
| 4,871,174 | 10/1989 | Kobayashi | 273/167 H |
| 4,877,249 | 10/1989 | Thompson | 273/169 |
| 5,320,353 | 6/1994 | Modre | 273/169 |

*Primary Examiner*—Sebastiano Passaniti
*Attorney, Agent, or Firm*—John R. Kirk, Jr.; Jenkens & Gilchrist

[57] ABSTRACT

A golf club head for drivers and fairway wood configurations having a planar face and two rear projections which extend rearwardly from the face of the golf club head is described to allow an adjustment of compression characteristics by changing the tension of the face. A tensioning assembly consisting of a nut and bolt attached to the two rear projections such that the tightening or loosening of the nut and bolt combination affects the pre-tension condition at the impact face area of the club head.

12 Claims, 1 Drawing Sheet

PRETENSIONED GOLF CLUB HEAD

BACKGROUND OF THE INVENTION

1. Field of the Invention

The present invention generally relates to golf club heads, and more specifically to the heads of metal woods and drivers with an adjustable, pre-tension condition at the impact face area of the club head that can be adjusted and tuned to match the golf ball compression and decompression characteristics in relation to the particular golfer's swing.

1. Description of Related Art

This invention relates to the improvements in performance of golf clubs when used to propel a golf ball by a transfer of linear momentum during the impact phase between the golf club head and the golf ball.

The transfer of a momentum between a hard surface of an impacting mass and a resilient golf ball, involves a complex process that not only involves the velocity pattern of the golf club head during the transfer mechanism but also the deflection pattern of the golf ball under compression.

In addition, with the use of the traditional wooden headed clubs, a reverse shock wave is reflected from the back of the head which has a dimensioned shape configuration that focuses the reverse shock wave to the impact face in such a time frame so as to coincide with the expansion of the golf ball from its maximum compressed state. Thus, an additional acceleration factor can be added to the release velocity of the golf ball.

One good golf shot makes up for many bad shots. Several good shots keeps one addicted to the sport. Thus, manufacturers of golfing equipment have endeavored to satisfy consumer demand for better performing and more mistake tolerant golf clubs and balls. For drivers and fairway woods, which are made out of the traditional wooden headed clubs, it is known that a reverse shock wave is reflected from the back of the head to the face of the club. Thus, an optimally dimensioned and shaped golf club head configuration could focus the reverse shock wave to the impact face of the club at a frequency rate which coincides with compression and subsequent expansion of the golf ball from its compressed state. Thus, optimal coincidence between the transfer of the reverse shock wave to the golf ball and of the expansion from the compressed state of the golf ball adds a maximum amount of additional acceleration to the release velocity of the golf ball after impact. Therefore, the industry has long attempted to manufacture such an optimally shaped and dimensioned wooden headed configurations.

Therefore, manufacturers have developed golf club heads which notably increased the distance a ball would travel after being struck. However, while golf club head performance improved, skillful techniques or either a lucky swing is required to avoid either hooking or slicing the ball. Therefore, many amateur golfers will frequently play at least one mulligan per 18 holes to escape the score penalties for one bad tee-shot.

In response to consumer demand for mistake tolerant equipment, thin wall golf club heads made by investment casting technology were introduced. These thin wall golf club heads are known for having a much larger "sweet spot" on the face of the golf club. The "sweet spot", of course, is the area of the golf club face which must strike the ball to yield a long and accurate shot. Because thin wall golf club heads have a cavity within the head, the reverse shock wave phenomena of the wooden heads is replaced by the deflection and subsequent return motion of the golf club face. Thus, the thin wall golf club heads have been manufactured to attempt to match the golf ball compression and expansion characteristics so as to achieve the effect of adding additional acceleration to the release velocity of the golf ball upon impact.

The introduction of thin wall golf club heads by the use of investment casting technology, has substituted the reverse shock wave phenomena by allowing the golf club face to deflect during golf ball compression during the first phase of impact. Thus, if the deflection and subsequent return motion have a time profile that matches the golf ball compression and expansion modes, then again there will be and additional acceleration phase applied to the release velocity of the golf ball.

However, it has been found that it is required to be extremely selective in the choice of the golf ball to be used with the so called "metal woods" in order to obtain the maximum performance possible. Moreover, with the tolerance used in the production of metal woods, the face thin-wall thickness can vary to the extent that the impact frequency characteristics can vary substantially between two apparently identical golf clubs made by the same manufacturer.

However, a problem with obtaining optimal deflection characteristics which match golf ball compression characteristics, is that the compression characteristics of the golf club head can vary substantially between two apparently identical golf clubs made by the same manufacturer. The reason for these variations is first a small difference in the thickness of the golf club face, a difference which is within tolerance, can have a large effect on the tension at the impact face area of the club head of the golf club and therefore its compression characteristics. Thus, a golfer must be extremely selective in the choice of his golf ball in order to obtain maximum performance possible. Indeed, different balls might be required to optimize the characteristic matching between the ball and the various fairway woods and driver. Unfortunately, the rules of golf do not allow ball substitution according to the club being used. Therefore, it is not realistically possible, to obtain maximum performance from a set of woods and driver with a given golf ball. This conclusion follows from the observation that, in all likelihood, each golf club will have a different deflection characteristic resulting from the production of the metal woods within known tolerances.

What is needed, therefore, is a golf club head design which allows the deflection characteristics to be fine-tuned and adjusted to match the golf ball compression characteristics for a given golf ball and a given golfer. The reason that the golfer fits into this equation, of course, is that the speed and energy of his or her swing affects the amplitude of the golf ball compression and, therefore, its compression characteristics.

SUMMARY OF THE INVENTION

The present invention relates to an adjustable golf club head of a metal wood type configuration which allows the golf club face deflection characteristics to be tuned to match the golf ball compression characteristics for a particular golfer's swing. The golf club head has two rear protrusions which extend from the facial area of the golf club head to the rear of the golf club head. Most metal woods include a cavity within the golf club head to create the "sweet spot". Similarly, the rear protrusions and the facial area of the golf club head jointly define a cavity within the golf club head which creates the "sweet spot" on the golf club face and which allows the face to deflect and return to a normal position. However, these two rear protrusions do not physically meet at any point. Therefore, the cavity extends all the way through to the end of the golf club head. In addition, a tensioning assembly, being comprised of a nut and a bolt, is integrally attached to each of the two rear protrusions. Therefore, when the nut is properly tightened onto the bolt, the two rear protrusions are compressed by the nut and bolt tensioning assembly toward each other. As these rear protrusions are compressed, i.e., urged toward each other, the pre-tension condition at the impact face area of the club head is changed, and thus the response characteristics of the golf club head are changed. Therefore, by loosening or tightening tensioning assembly, the compression characteristics of the golf club head may be adjusted to match the compression characteristics of the golf ball for a given swing. Therefore, if this configuration is applied to the driver as well as to each of the fairway woods, the various clubs may be fine tuned to maximize performance for a given ball and a given golfer.

While there are variations as to the shape and placement of the cavity of the adjustable golf club head, one embodiment includes a cavity which is shaped similar to three pipes connected by a T-connector. Specifically, the first cavity section in the head of the golf club lies behind and approximately parallel to the planar face of the golf club and is perpendicular to a linear axis which perpendicularly extends through the planar face of the golf club. A second cavity section joins the first cavity section and extends to the back of the adjustable golf club head between the rear projection in a manner which is approximately parallel to the linear axis and to the ground. Moreover, in this embodiment, the cavity is filled with a resilient elastomeric filler.

An embodiment of the adjustable golf club head also comprises one or more drilled apertures within the golf club head for housing an internal weight. Typically, this aperture is drilled from the rear of the golf club head and extends in a direction approximately parallel to the linear axis of the golf club head. Accordingly, an internal weight designed to snugly fit within the drilled aperture is installed. In one embodiment the internal weight weighs approximately 200 grams.

Depending on the size of the cavities and whether such cavities are filled with resilient elastomeric filler, one embodiment of the adjustable golf club head includes at least one lug mounted on and extending from one of the two rear protrusions to interact with either the other rear protrusion or with the lug of the other rear protrusion to limit the amount of adjustment of the tensioning assembly and therefore to the pre-tension condition at the impact face area of the club head. The reason for the limiting the range of adjustment and, therefore, the pre-tension condition at the impact face area of the club head is that excessive pre-tension condition at the impact face area of the club head may result in permanent distortion of the face of the golf club head.

BRIEF DESCRIPTION OF THE DRAWINGS

The accompanying drawings which are incorporated in and form a part of the specification, illustrate various embodiments of the present invention and together with a description, serve to explain the principles of the invention. In the drawings.

DETAILED DESCRIPTION OF THE INVENTION

Metal woods and drivers include a cavity within them which allows the golf club head face to deflect upon striking the ball and, overall, to provide a larger "sweet spot" on the face of the golf club. By "sweet spot", what is meant is that the area of the face of the golf club which can strike the ball and still result in an accurate and long shot is enlarged. Designs which create a larger "sweet spot" are more fault tolerant and are especially good at allowing novice golfers the opportunity of playing the game with a certain improved degree of apparent skill. Therefore, with the advent of the metal wood which has a cavity and increased "sweet spot", consumer demand encourages manufacturers to produce golf club heads with enlarged "sweet spots" and with high performing characteristics as well. As has been discussed heretofore, the invention herein includes a golf club head 1 whose deflection characteristics may be tuned and adjusted to match the compression characteristics of the golf ball resulting from a constant swing. In order to achieve this, the cavity 14 of the metal wood is extended through the back of the golf club head 1 behind the planar face 1*b*. The response characteristic of a deflecting diaphragm is dependent on the amount of pre-tension condition at the planar impact face area 1*b* of the club head 1 which is dependent upon the shape of the periphery of the club head 1. It is a feature of this invention to provide adjustment of the periphery of the rear of the metal woods to allow the pre-tension condition at the impact face area 1*b* of the club head 1 to be adjusted, to achieve optimum performance. The tension adjustment of the planar face 1*a* is accomplished with at least two substantially parallel protrusions 9 and 10 rearwardly extending from the planar face 1*a* of the club head 1.

Figure 1:
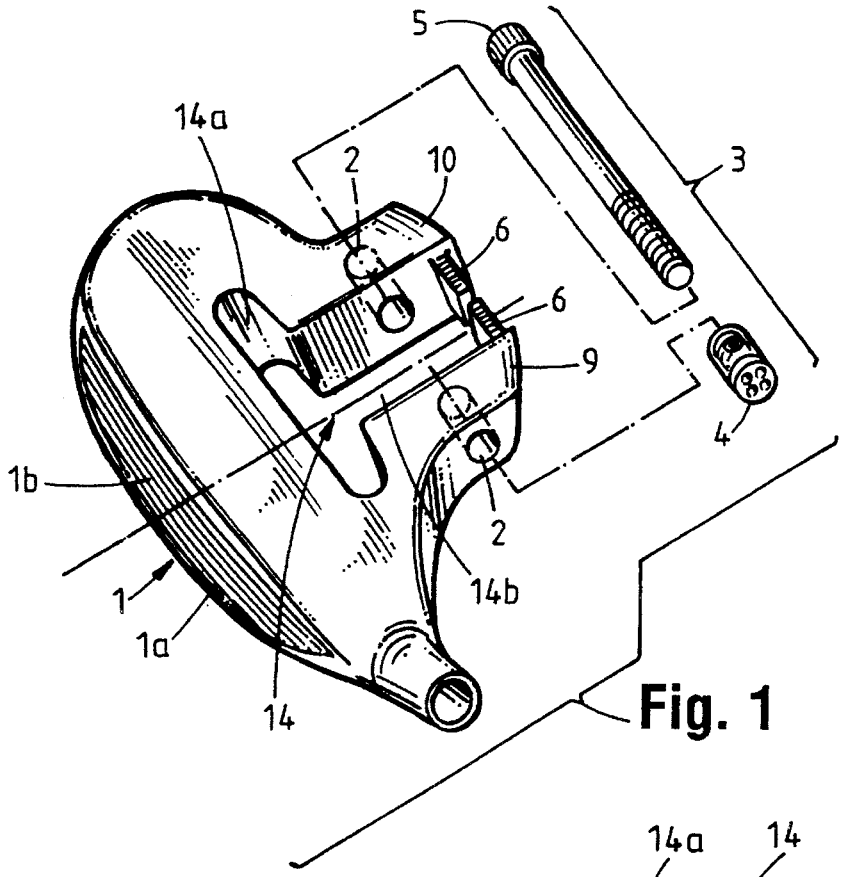
FIG. 1 is an isometric view of the golf club head having two rear protrusions that are fitted with a tensioning assembly consisting of a nut and bolt.
Figure 2:
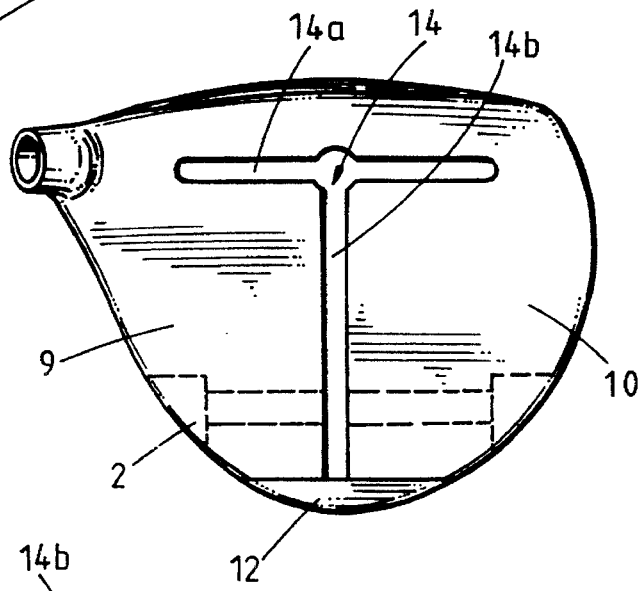
FIG. 2 is a top view of one embodiment of the adjustable golf club head showing the arrangement of the first and second cavity and of the tensioning assembly.

The golf club head 1 also has a cavity 14 which is shown in FIG. 1, defined by an area behind, and preferably parallel to the front face 1*a* and the parallel protrusion 9 and 10. As is shown in FIG. 1, the size of the cavity 14 when viewed from above, is relatively large in comparison to the overall width of the back of the golf club head 1. In the preferred embodiment, as is shown in FIG. 2, the cavity 14 is shaped similar to that of a T-connector for pipes. In both embodiments, a first cavity section 14*a* is oriented behind and extends in a direction approximately parallel to the face 1*a* of the golf club head 1. A second cavity section 14*b* joins the first cavity section 14*a*, preferably approximate the center of the planar impact face, and extends toward the rear of the golf club head 1 between rear projections 9 and 10. There are many variations with respect to the size, shape and location of the cavity 14. The preferred embodiment also contains an elastomeric filler within the cavity 14. One skilled in the art would need to perform only insignificant experimentation to determine the optimum size, shape and placement of the cavity 14 as well as the elastomer fill.

To provide the pretensioning of the planar face, holes 2 drilled on a common axis as is shown in FIG. 1 drilled, preferably countersunk, in the rearward protrusions 9 and 10. The performance characteristics and the sensitivity of the golf club is made through adjustments to the tensioning assembly 3 which is comprises a bolt 5 threaded on one end to receive a bolt 4. When nut 4 is tightened onto bolt 5 once the nut 4 and bolt 5 of the tensioning assembly 3 have been placed in the holes 2, the effect will be to urge rear protrusions 9 and 10 toward each other. The shape of the rear of the golf club head 1 is therefore adjusted, which results in a different pre-tension condition at the impact face area 1*b* of the club head 1 which therefore results in different compression characteristics.

The placement of holes 2 in the rear protrusions 9 and 10 of the adjustable golf club head 1 may be moved in either forward, toward the face 1*a* of the golf club head 1, or backward toward the back of the golf club head 1 to suit the adjustment purpose. As the placement of the holes 2 is moved from front to back, more turns of nut 4 onto bolt 5 will be required for a given amount of compression of the rear protrusions 9 and 10 toward each other.

On each of the rear protrusions 9 and 10 is placed a lug 6 which extends toward the other protrusion 9 or 10 of the golf club head 1 so as to engage the lug 6 of the other rear projection 9 or 10 if the rear protrusions 9 and 10 are pulled to close together. In this embodiment, (FIG. 1) two lugs 6 are shown, each extending from a rear protrusion, equally sized and placed to integrally correspond with each other. Thus, after a certain amount of adjustment has occurred, the two lugs 6 will engage each other and prevent further adjustment and golf club head 1 and, therefore, further shape manipulation. Thus, once the two lugs 6 engage each other, the only adjustment possible is to loosen the nut 4 from the bolt 5 thereby allowing the rear protrusions 9 and 10 to expand away from each other thereby changing the pre-tension condition at the impact face area 1*b* of the club head 1 and therefor the deflection characteristic of the face 1*a* of the golf club head 1. It is important to note that this particular arrangement of lugs 6 is just one means of limiting the amount of adjustment. First, the use of such lugs 6 may not be necessary depending upon factors such as the size of the cavity 14 and whether the cavity 14 is filled with a substance such as an elastomeric filler. Moreover, instead of having two lugs 6 which integrally interact with each other, the invention could include having just one lug 6 that reaches from one rear protrusion 9 or 10 to the other.

With respect to the tensioning assembly 3, it should be noted that the various embodiments used by the inventor herein, include a special nut 4 and bolt 5 which cannot be readjusted after being set. The purpose of utilizing such a special nut 4 and bolt 5 is to comply with current PGA requirements which do not allow adjustment of performance characteristics of a golf club once play has begun. The back of the golf club head 1 may also include an elastomeric back piece 12 (FIG. 2) which covers the cavity 14.

Figure 3:
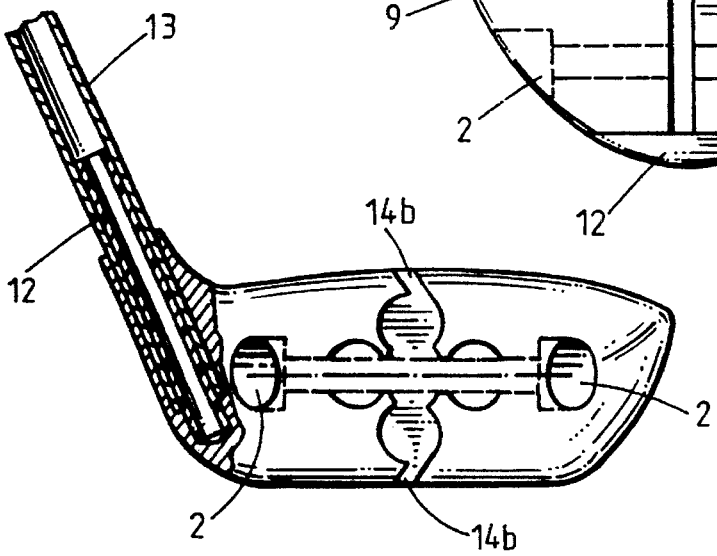
FIG. 3 is rear elevation of the golf club head showing the location and placement of an alternative embodiment of the first and second cavities, the tightening assembly, as well as the reinforcement sleeve for securing the golf club shaft.

FIG. 3, a rear elevation view of the golf club head 1 shows yet another embodiment of the cavity 14 cut in a manner which prohibits a view through the club head to the ground providing a more traditional appearance when poised to strike the ball. An additional feature, not shown, are drilled apertures to snugly house weight in the preferred embodiment. Obviously, the size and shape of the drilled aperture is a function of the weight, preferably about 200 grams, selected for placement within the golf club head 1. Finally, FIG. 3 shows the internal reinforcement sleeve 12 which is designed to mate with the golf club shaft 13. This internal reinforcement sleeve 12 is particularly preferred if a graphite shaft is being utilized with the current invention.

Having described this invention and given examples thereof, one of ordinary skill in the art having this description before them would be able to make many modifications and adjustments to the invention without departing from the scope of the invention as claimed herein.

I claim:

1. A golf club head of a metal wood design having an adjustable pre-tension condition at the impact face area of the club head to maximize performance of the club for a specific golfer which comprises:

a golf club head having a planer face with an impact face area and linear axis extending perpendicularly through the planar face;

at least two substantially parallel rear projections projecting rearwardly from the planer face, each rear projection being drilled with holes on a common axis to receive a tensioning assembly; and a tensioning assembly comprising a bolt extending through the holes in the rear projections threaded to receive a nut in a direction perpendicular to the linear axis whereby the adjustment of the tensioning assembly causes the rear projections to compress toward each other thereby changing the pre-tension condition at the impact face area of the club head.

2. The golf club head of claim 1 which further comprises an internal re-enforcement sleeve to mate with and to secure a golf club shaft to the golf club head.

3. The golf club head of claim 1 wherein the cavity has the approximate shape defined by a first cavity section oriented behind and substantially parallel to the planer face and perpendicular to the linear axis and a second cavity and which joins extends from the first cavity section to a back of the club head between the rear projections.

4. The golf club head of claim 1 which further comprises a resilient elastomeric filler to fill the cavity enveloped by the golf club head and the rear projections.

5. The golf club head of claim 4 which further comprises an elastomeric cap mounted on and covering the back of the adjustable golf club head.

6. The golf club head of claim 1 which further comprises a lug mounted upon and extending from one of said rear projection toward the other rear of said rear projection to limit the adjustment of the tensioning assembly and therefor the amount of possible compression of the two rear projections.

7. The golf club head of claim 6 wherein the adjustable golf club head further comprises an internal re-enforcement sleeve to mate with and to secure a golf club shaft to the golf club head.

8. The golf club head of claim 7 wherein the golf club is further comprised of a drilled aperture within the golf club head for housing an internal weight.

9. The golf club head of claim 8 wherein the internal weight weighs approximately 200 grams.

10. The golf club head of claim 3 wherein the golf club is further comprised of a resilient elastomeric filler to fill the cavity enveloped by the golf club head and the rear projections.

11. The golf club head of claim 10 wherein the golf club is further comprised of an elastomeric cap which is mounted on and covers the back of the adjustable golf club head.

12. A golf club head having an adjustable pre-tension condition at the impact face area of the club head which comprises:

a golf club head having a planer face with an impact face area and linear axis extending perpendicularly through the planar face;

at least two substantially parallel rear projections projecting rearwardly from the planer face, each rear projection being drilled with holes on a common axis to receive a tensioning assembly;

a tensioning assembly comprising a bolt, threaded to receive a nut, extending through the holes in the rear projections in a direction perpendicular to the linear axis whereby the adjustment of the pre-tension condition at the impact face area of the club tensioning assembly causes the rearwardly protruding toward compress the rear projections to each other thereby changing the pre-tension condition at the impact face area of the club head;

a lug mounted upon and extending from one of said rear projections toward the other of said rear projections to limit the adjustment of the tensioning assembly;

an internal re-enforcement sleeve to mate with and to secure a golf club shaft to the golf club head;

an aperture within the golf club head for housing an internal weight;

a cavity which has the approximate shape defined by a first cavity section in the head oriented behind and substantially parallel to the planar face and perpendicular to the linear axis and a second cavity section which joins and extends from the first cavity section to a back end of the adjustable club head between the rear protrusions;

a resilient elastomeric filler to fill the first and second cavity sections; and an elastomeric cap which is mounted on and covers the back of the adjustable golf club head.

* * * * *

UNITED STATES PATENT AND TRADEMARK OFFICE

CERTIFICATE OF CORRECTION

PATENT NO. : 5,501,453

DATED : March 26, 1996

INVENTOR(S) : Douglas Hurst

It is certified that error appears in the above-identified patent and that said Letters Patent is hereby corrected as shown below:

Claim 12 (Col. 7, lines 8-9):

after "protruding" delete "toward compress the rear projections to", and insert therefor, -- rear projections to compress toward ---.

Signed and Sealed this

Fifteenth Day of October, 1996

*Attest:*

Bruce Lehman

BRUCE LEHMAN

*Attesting Officer*

*Commissioner of Patents and Trademarks*